US005829290A

United States Patent [19]

Harvey

[11] Patent Number: 5,829,290

[45] Date of Patent: Nov. 3, 1998

[54] RESHAPING OF CONTAINERS

[75] Inventor: David Harvey, Oxon, Great Britain

[73] Assignee: Crown Cork & Seal Technologies Corporation, Alsip, Ill.

[21] Appl. No.: 932,797

[22] Filed: Sep. 4, 1997

Related U.S. Application Data

[63] Continuation of Ser. No. 621,795, Mar. 22, 1996, abandoned.

[30] Foreign Application Priority Data

Feb. 14, 1996 [GB] United Kingdom ..... 9603110
Mar. 6, 1996 [GB] United Kingdom ..... 9604784

[51] Int. Cl.[6] ..... B21D 26/02

[52] U.S. Cl. ..... 72/58; 72/62

[58] Field of Search ..... 72/58, 59, 61, 72/62

[56] References Cited

U.S. PATENT DOCUMENTS

| | | | |
|---|---|---|---|
| D. 356,501 | 3/1995 | Kornick et al. | D9/518 |
| 840,091 | 1/1907 | Schumacher et al. | 72/58 |

(List continued on next page.)

U.S. PATENT DOCUMENTS

| | | | |
|---|---|---|---|
| 2,083,943 | 6/1937 | Clifford | 113/116 |
| 2,748,464 | 6/1956 | Kaul | 29/535 |
| 2,980,993 | 4/1961 | Lyon | 29/534 |
| 3,029,667 | 4/1962 | Sporck | 80/5 |
| 3,040,684 | 6/1962 | Hillgren | 72/58 |
| 3,224,239 | 12/1965 | Hansson | 72/62 |
| 3,335,590 | 8/1967 | Early | 72/58 |
| 3,461,699 | 8/1969 | Roth | 72/56 |
| 3,610,018 | 10/1971 | Swanson et al. | 72/348 |
| 3,757,555 | 9/1973 | Blutt et al. | 72/63 |
| 3,831,416 | 8/1974 | Wolfe | 72/117 |
| 3,896,648 | 7/1975 | Schertenleib | 72/61 |
| 3,911,707 | 10/1975 | Minakov et al. | 72/76 |
| 4,055,064 | 10/1977 | Schow | 72/118 |
| 4,289,007 | 9/1981 | Kraft | 72/58 |
| 4,414,834 | 11/1983 | Gratzer et al. | 72/58 |
| 4,827,747 | 5/1989 | Okada et al. | 72/59 |
| 4,947,667 | 8/1990 | Gunkel et al. | 72/56 |
| 5,058,408 | 10/1991 | Leftault, Jr. et al. | 72/56 |
| 5,187,962 | 2/1993 | Bilko et al. | 72/62 |
| 5,214,948 | 6/1993 | Sanders et al. | 72/58 |
| 5,261,261 | 11/1993 | Ramsey | 72/105 |
| 5,261,558 | 11/1993 | Claydon | 220/671 |
| 5,326,250 | 7/1994 | Doudement | 425/541 |
| 5,334,007 | 8/1994 | Denis et al. | 425/526 |
| 5,338,181 | 8/1994 | Denis et al. | 425/526 |
| 5,342,558 | 8/1994 | Denis et al. | 264/25 |
| 5,622,070 | 4/1997 | Bulso, Jr. | 72/68 |

FOREIGN PATENT DOCUMENTS

| | | |
|---|---|---|
| 0 521 637 B1 | 8/1994 | European Pat. Off. . |
| 0 543 695 A1 | 11/1992 | France . |
| 1 031 257 | 6/1958 | Germany . |
| 1 925 014 | 11/1970 | Germany . |
| 2 131 811 | 12/1972 | Germany . |
| 23 08 420.0 | 2/1973 | Germany . |

(List continued on next page.)

OTHER PUBLICATIONS

Frederic Swing Crispen, C.E. "Dictionary of Technical Terms" Bruce Publishing p. 16 (1946).

*Primary Examiner*—David Jones
*Attorney, Agent, or Firm*—Woodcock Washburn Kurtz Mackiewicz & Norris LLP

[57] ABSTRACT

A method and apparatus for the reshaping of containers is described. A mold having at least three parts is used to hold the container blank. Pressurized air supplied to the cavity of the container causes it to expand to take on the shape of the mold chamber. Whilst this operation is taking place, the mold parts move towards each other under the action of pistons which load both ends of the mold and container, thus preventing longitudinal tension in the container wall. The mold parts are initially spaced from each other by gaps or split lines which are reduced by the movement of the mold parts towards each other but are never completely closed up.

47 Claims, 2 Drawing Sheets

FOREIGN PATENT DOCUMENTS

Figure 1:
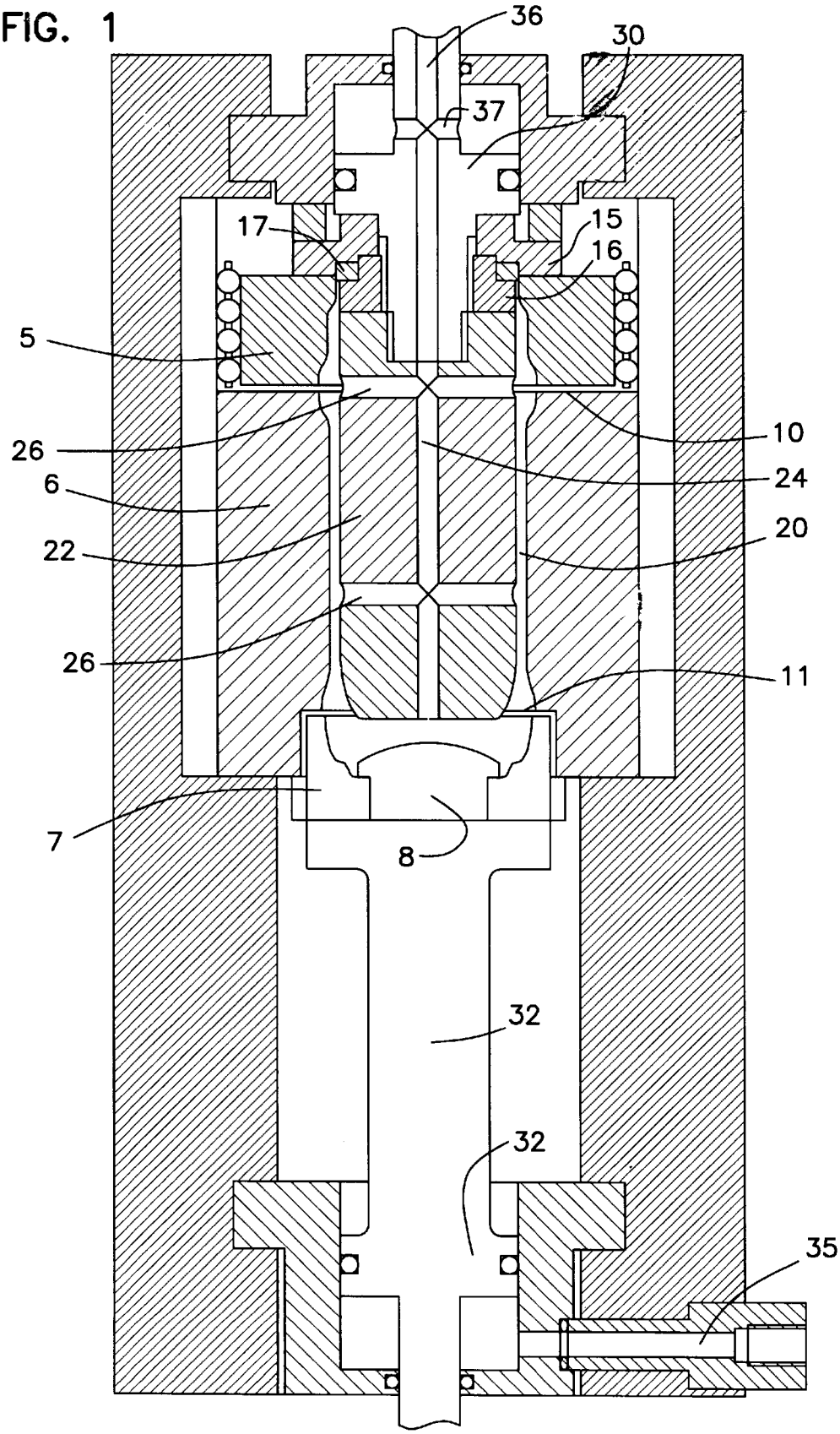

| | | | |
|---|---|---|---|
| 3 337 382 A1 | 4/1985 | Germany . | |
| 3 716 176 A1 | 9/1988 | Germany . | |
| 94 11 461.7 | 10/1994 | Germany . | |
| 57-44426 | 3/1982 | Japan | 72/58 |
| 58-613946 | 12/1983 | Japan . | |
| 58-613946-1 | 11/1985 | Japan . | |
| 61-255725 | 11/1986 | Japan . | |
| 62-199232 | 9/1987 | Japan . | |
| 63-724416 | 2/1988 | Japan . | |
| 63-052721 | 3/1988 | Japan . | |
| 63-727797 | 3/1988 | Japan . | |
| 63-724416-1 | 11/1988 | Japan . | |
| 63-748958 | 11/1988 | Japan . | |
| 64-002733 | 1/1989 | Japan . | |
| 907967 | 10/1994 | Japan . | |
| 07124656 | 5/1995 | Japan . | |
| 7-165224 | 6/1995 | Japan . | |
| 932536 | 8/1995 | Japan . | |
| 971981 | 1/1997 | Japan . | |
| 388 887 | 6/1965 | Switzerland . | |
| 1570820 | 6/1990 | U.S.S.R. . | |
| 1755992 | 8/1992 | U.S.S.R. | 72/58 |
| 216 704 | 6/1924 | United Kingdom . | |
| 1 279 421 | 6/1972 | United Kingdom . | |
| 1 309 695 | 3/1973 | United Kingdom . | |
| 2 003 416 | 8/1979 | United Kingdom . | |
| 2 123 329 | 2/1984 | United Kingdom . | |
| 2120148 | 7/1985 | United Kingdom . | |
| 2 224 965 | 4/1990 | United Kingdom . | |
| 2 257 073 | 1/1993 | United Kingdom . | |
| 2 266 290 | 10/1993 | United Kingdom . | |
| WO 83/01916 | 6/1983 | WIPO . | |
| WO 92/13653 | 8/1992 | WIPO . | |
| WO 95/08410 | 3/1995 | WIPO . | |
| WO 95/15227 | 6/1995 | WIPO . | |

RESHAPING OF CONTAINERS

This is a continuation of application Ser. No. 08/621,795, filed Mar. 22, 1996, now abandoned.

This invention relates to a method and apparatus for reshaping of containers. In particular, it relates to the reshaping of containers such as metal cans. Reshaping of cans will also be referred to hereinafter as "forming".

Pneumatic reshaping of containers such as three piece steel aerosol cans is known from GB-A-2257073 ('073) which uses a split mould comprising sleeves around a liner to define the desired final shape. A mandrel acts as a space saver within the container to be reshaped and supplies air to the interior of the container within the mould to cause it to expand outwardly against the liner. Both ends of the container are held in position by slidable clamping members. As the container expands outwardly, either or both of the upper and/or lower clamping members is/are free to move inwardly to reduce thinning of the container body. This movement requires careful design to avoid any gaps into which the side wall of the container body might expand during reshaping. Only simple shapes with limited expansion are therefore possible with this apparatus.

A liquid forming method is proposed in U.S. Pat. No. 3,335,590 (Early) for the reshaping of tube blanks. That patent describes a split die which encloses the tube blank and comprises several segments positioned between a stationary top section and a moveable bottom section. The enclosed die position is within ±0.01 inch. A single piston creates an axial load on the tube blank to cause the die segments to close up whilst a liquid volume control system "bulges" the tube within the die. A balance system balances the axial load pressure and bulge pressure to maintain the enclosed die position. The patent describes a three part die which effectively has floating segments and splits between the segments. As the tube expands, it also shortens in height until the splits are closed up to maintain the enclosed die position when the final shape of the tube is reached. Early uses a hydraulic process which is much easier to control than forming using air, such as is described in GB-A-2257073.

Although the system of Early purports to be capable of forming complex parts in a controlled manner, in practice, the system is not capable of controlling the movement of the tube within the mould to the degree which is necessary in the reshaping of thin walled can bodies at commercially acceptable speeds.

Another liquid forming method is described in CH-A-388887 which uses a press assembly to provide an axial load to a hollow body in a two part mould. In a first forming steep, the press closes the mould and compresses the hollow member. A second step uses a piston which forces liquid into the hollow body to cause it to expand outwardly against the mould.

As with the Early patent, the use of a liquid results in contamination of the inner surface of the item to be reshaped. Furthermore, this system is not capable of forming complex shapes.

The basic principle of all the above methods is to force the wall of the tube/body to expand to take on the shape of the closed up cavity. As is noted in the first example ('073), it is desirable to minimise thinning during the forming process. This is particularly the case with modern can bodies which are already made of material which is extremely thin in order to reduce raw material costs. Additionally, if the can is a two piece drawn and wall-ironed can, then the material of the wall-ironed can side wall is thinner than that of the neck region and has been subjected to work hardening. The more the material has been worked, the less strain it can take before fracture. Consequently, wall-ironed cans are even more susceptible to splitting during the forming process than are cans with a seamed side wall of constant thickness such as are described in '073.

According to the present invention, there is provided a method of reshaping a hollow container comprising: placing a container blank into a chamber defined by a mould having three parts; supplying a pressurised fluid to the interior cavity of the hollow container to expand the container radially outwards onto the inner surface of the mould; and moving the mould parts towards each other from a first position in which the parts are spaced from each other by gaps which open into the could chamber, to a second position in which the gaps between the mould parts are reduced in size whilst still opening into the mould chamber.

As the container expands outwardly, a loss of height occurs. Since the gaps between the mould parts are not completely closed up at the end of the forming operation, it is ensured that height of the container is "lost" from the gap positions throughout most of the forming process. If the mould were to close up completely before the end of the forming process, then the side wall of the container may split due to excessive longitudinal tension. The initial gaps between the mould parts are typically set to a height which is greater than the expected height loss in the container after reshaping. Clearly this height will vary according to the degree of expansion required.

The gaps or "split lines" in the mould are advantageously positioned at the points of maximum expansion of the container. This limits the length of can side wall which will slide over the mould cavity wall during the process. Initially, as the pressurised fluid is introduced to the container cavity, the side wall moves outwards until it contacts the narrowest parts of the mould. In a simple shape, if the gaps are at the points of maximum expansion, the container material will not move on the points of contact with the mould during further expansion, since movement of material will occur where there is least resistance to such movement, i.e. where there is no contact with the mould.

In a more complex shape, once the container contacts the mould, the metal of the container tends to slide on the contact points with the mould, giving rise to local frictional forces. As these frictional forces increase, so does the longitudinal tension in the container side wall. Only minimal elongation in the side wall is then possible before splitting ensues. It is therefore beneficial to minimise longitudinal tension and frictional forces. By positioning two gaps at the points of maximum expansion in the mould of the present invention height can be lost throughout most or all of the forming process, so that longitudinal tension is limited.

In a preferred embodiment, the method further comprises applying a load to both ends of the container. Longitudinal tension is also kept to a minimum by this loading of the container during reshaping, since the load advantageously balances the cavity pressure to avoid any splitting of the wall. The load may be either a constant or a variable load as required by the shape desired.

Usually the load is applied by a pair of pistons which act both on the mould parts, to cause them to move towards each other and, simultaneously, provide a compressive force which reduces or overcomes the longitudinal tension in the container side wall.

The pistons may typically be actuated by fluid pressure, usually air pressure. This pressure may be applied independently or to any combination of the pistons and the container cavity. Preferably, a single air pressure supply is used for one of the pistons and the cavity. That supply is advantageously split for the piston and cavity as close as possible to the piston so as to minimise losses and to maintain the same pressure supplied to the cavity and piston. The cavity pressure and piston pressure are thus automatically balanced throughout the process and any variability in the supply pressure will not affect the process as much. By using two pressure supplies, it is possible to vary the pressure and the timings of pressurisation between the cavity and the pistons. As a result, the process becomes more versatile.

The pistons preferably act on an area which is the cross sectional area of the unformed container or slightly larger. If the pressure in the piston and the container is the same, the force from the piston cancels out the longitudinal force resulting from the internal pressure.

In a preferred embodiment, only contact of the expanded container with the mould wall prevents further movement of the pistons or other loading means. The pistons preferably will not reach the limit of their stroke before the container is fully reshaped.

The method may also comprise means for regulating the air flow to control the rate of pressure rise in the two pistons and the cavity. Flow regulation provides fine control of the pressure balance between the pistons which may need to be either different or matched according to the complexity of the shape required.

According to a further aspect of the present invention, there is provided a method of reshaping a two piece can into a shape having two or more enlarged regions, the method comprising: placing the container blank into a chamber defined by a mould having three parts spaced from each other by gaps which open into the mould chamber and each of which is at, or substantially at, the position of maximum expansion of one of the enlarged regions; supplying a pressurized fluid to the interior cavity of the hollow container to expand the container radially outwards onto the inner surface of the mould; and moving the mould parts towards each other as the can is being expanded.

According to a still further aspect of the present invention, there is provided an apparatus for reshaping a hollow container comprising: a mould having three parts defining a chamber to accommodate a container blank; means for supplying a pressurised fluid to the interior cavity of the hollow container to expand the container radially outwards onto the inner surface of the mould; and means for moving the mould parts towards each other from a first position in which the parts are spaced from each other by gaps which open into the mould chamber to a second position in which the gaps between the mould parts are reduced in size whilst still opening into the mould chamber.

This apparatus may advantageously be used to carry out either of the methods described above.

Figure 2:
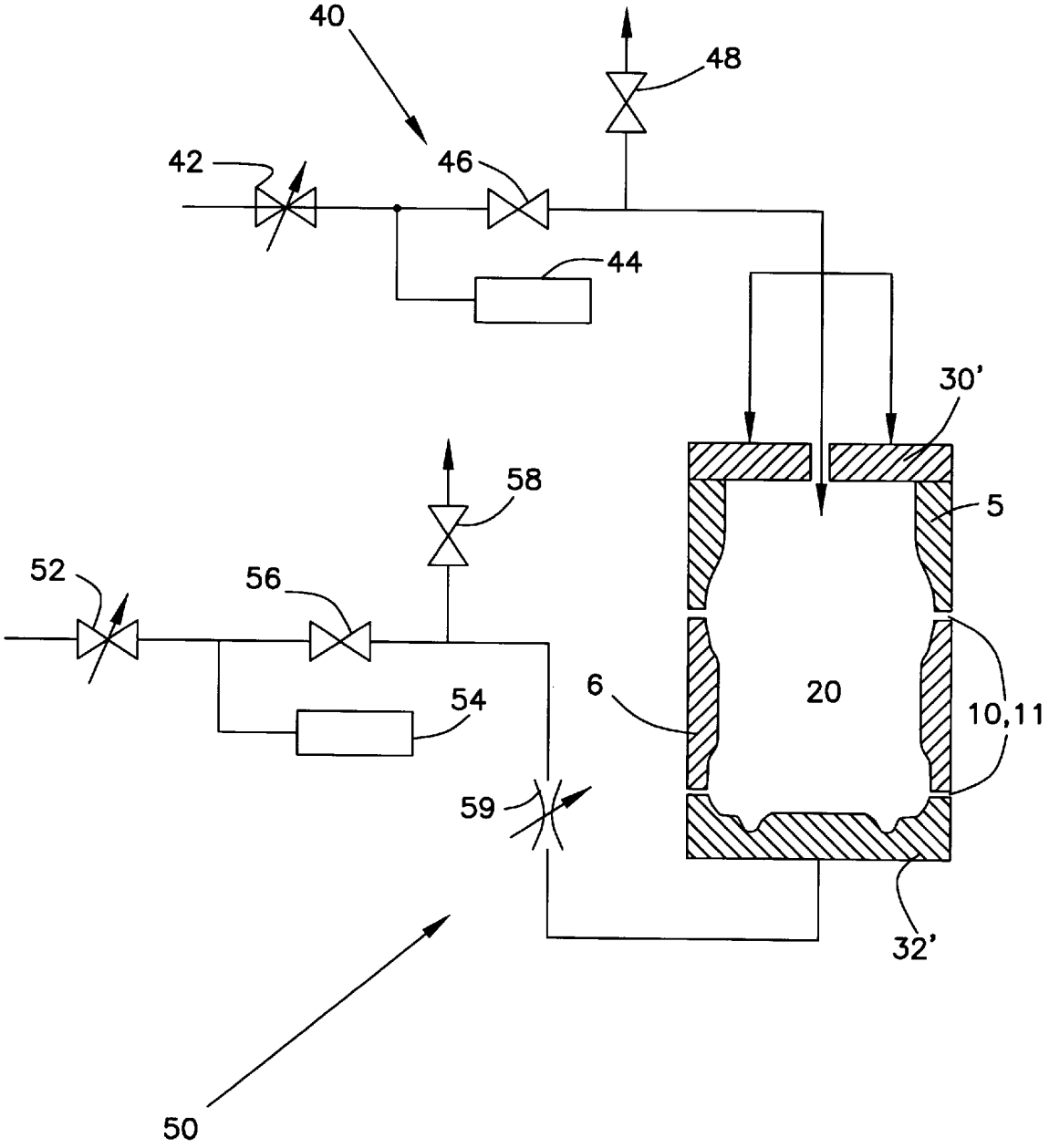

A preferred embodiment of the present invention will now be described, by way of example only, with reference to the drawings, in which:

FIG. 1 is a sectioned side view of an apparatus for reshaping a can body; and FIG. 2 is a circuit diagram for a circuit to supply pressurised air to two pistons and a can cavity.

In FIG. 1 there is shown a mould 1 for reshaping ("blow forming") a can body. The can body is a drawn and wall ironed can body having an integral base and side wall and necked at its upper open end.

The mould has three die parts 5, 6 and 7 which comprise neck ring, side wall and base support respectively. The die parts are separated from each other by gaps or "split lines" 10 and 11. For ease of machining, the base support die 7 is made in two parts, with a central part 8 supporting the base dome of the can body. The neck ring 5 provides simple support to the necked portion of the can body. These components together define a chamber 20 to receive the can body and are machined to the desired final shape of the can body after blow forming.

A pair of seal and support rings 15, 16 and a rubber sealing wing 17 are provided to seal the top edge of the container body. A space saving mandrel 22 passes through the centre of the seal and support rings to a position just above the base support dome 8. The mandrel 22 supplies air to the cavity of a can body within the chamber 20 via a central bore 24 and radial passages 26. The apparatus further includes an upper piston and a lower piston 30, 32 which together apply a load to both ends of the can in the mould chamber 20. Lower piston 32 is moveable upwards by means of a pressurised air supply which is fed to the piston via passage 35. Similarly, the upper piston is moveable downwards by means of a pressurised air supply which is fed to the piston via passages 36 and 37. In the preferred embodiment shown, the passage 36 is connected to the central bore 24 of the mandrel 22 so that the upper piston and can cavity share a common air supply. The common air supply is split for the piston 30 and cavity at the junction of the air passage 37 and the central mandrel bore 24, within the piston 30 so as to minimise losses and to maintain the same pressure supplied to the cavity and piston. The cavity pressure and piston pressure are thus automatically balanced throughout the process.

A schematic circuit diagram which shows how air is supplied to the pistons and can cavity is shown in FIG. 2. In the figure, the upper piston 30 and seal and support rings 15,16 are shown schematically as a single unit 30'. Likewise, the base support 7,8 and lower piston 32 are shown as a single unit 32'. Units 30' and 32' and neck ring 5 are movable, whereas the side wall die 6 of the mould is fixed.

The circuit comprises two pressure supplies. Pressure supply 40 supplies pressurised air to the top piston 30 and cavity of the can within the mould chamber 20. Pressure supply 50 supplies pressurized air to the lower piston 32 only.

The two supplies each comprise pressure regulators 42,52, reservoirs 44,54, blow valves 46,56 and exhaust valves 48,58. In addition, the lower pressure supply 50 includes a flow regulator 59. Optionally, the upper pressure supply 40 may also include a flow regulator, although it is not considered essential to be able to adjust the flow in both supplies. Reservoirs 44, 54 prevent a high drop in supply pressure during the process.

Typically, high pressure air of around 30 bar is introduced to the can cavity and to drive the top of the can. The air pressure to drive the bottom piston 32 is typically around 50 bar, depending on the piston area. The air pressure within the can cavity provides the force which is required to expand the can outwards but also applies an unwanted force to the neck and base of the can which leads to longitudinal tension in the can side wall The two pistons are thus used to drive the top and the bottom of the can, providing a force which counteracts (i.e. balances) this tension in the can side wall.

The pressure of the air supplied to the pistons is critical in avoiding failure of the can during forming due to either splitting or wrinkling. Splitting will occur if the tension in the can side wall is not counteracted by the piston pressure since the pressure is too low. Conversely, the pressure of the air supplied should not be so high that this will lead to the formation of ripples in the side wall.

For this reason, no stops are required to limit the stroke of the pistons. If the stroke were limited, the can might not be fully expanded against the mould wall before the pistons reached the stops. If this occurs, the tension in the can side wall would cease to be balanced by the piston pressure with a consequent risk of splitting. In effect, the contact of the expanded can with the side wall of the mould prevents further movement of the pistons.

It should be noted therefore that the balance between the can cavity pressure and the piston pressure must be maintained at all times throughout the forming cycle so that the rate of pressure rise in the cavity and behind the pistons must be balanced throughout the cycle. The rate of pressure rise can be controlled by the flow regulator 59 or by adjusting the supply pressure via the pressure regulators 44,54.

In order to form the can, the blow valves 46,56 are first opened. It is possible to have a short delay between the opening times of the blow valves if required to obtain a better match between the piston and cavity pressures but there will then need to be a higher rate of pressure rise for one circuit in order to maintain this balance. A delay can also be used to compensate for different pipe lengths, maintaining a pressure balance at the time of forming. The upper supply 40 is split for the piston 30 and cavity as close as possible to the piston 30 as described above for FIG. 1.

The apparatus is designed so that, at the latest, when each piston reaches its maximum travel the can is fully reshaped and the gaps 10,11 are not closed up at the end. Closing of the gaps leads to splitting of the can due to excessive tension in the side wall in the same way as does limiting movement of the pistons before full expansion has occurred. However, the final gap should not be excessive since any witness mark on the side wall becomes too apparent, although removal of sharp edges at the split lines alleviates this problem.

Once the reshaping operation is completed, the air is exhausted via valves 48 and 58. Clearly the exhaust valves are closed throughout the actual forming process. It is important that both supplies are vented simultaneously since the compressive force applied by the pistons to balance the cavity pressure (longitudinal tension) may be greater than the axial strength of the can so that uneven exhausting leads to collapse of the can.

EXAMPLE

Two piece can bodies were "blow formed" using the apparatus of FIG. 1 to give a maximum expansion of 8%. The relevant dimensions before and after forming are given in table 1 below.

TABLE 1

| Dimension | Original (mm) | After forming (mm) |
|---|---|---|
| Can height | 168 | 165.3 |
| Neck diameter | 62.16 | unchanged |
| Outside diameter | 65.953 | 8% max increase |
| Upper split line | 2.3 | 0.375 |
| Lower split line | 1.15 | 0.375 |

I claim:

1. A method of reshaping a hollow container comprising:

placing a container blank having an interior forming a cavity into a chamber defined by a mold having an inner surface and comprising three parts, the mold having a longitudinal axis defining an axial direction;

supplying a pressurized fluid to the interior cavity of the hollow container to expand the container radially outwards onto the inner surface of the mold; and moving the mold parts axially towards each other from a first position in which the parts are spaced from each other by gaps which open into the mold chamber to a second position in which the gaps between the mold parts are not closed but are reduced in size whilst still opening into the mold chamber, the mold parts being moved during the radial expansion of the container.

2. A method according to claim 1, further comprising positioning the gaps at the points of maximum expansion of the container.

3. A method according to claim 1, further comprising applying an axial load to both ends of the container during its radial expansion.

4. A method according to claim 3, comprising balancing the force exerted by the pressurized fluid on the interior of the container and the load applied to the ends of the container.

5. A method according to claim 1, wherein the movement of the mold parts and the radial expansion of the container occur simultaneously.

6. A method according to claim 1, wherein the container is made from metal.

7. A method according to claim 6, wherein the container blank is formed by being drawn and ironed prior to placing it into the mold chamber.

8. A method according to claim 1, wherein the pressurized fluid is air.

9. A method according to claim 8, further comprising the step of inserting a mandrel into the container prior to the step of supplying the pressurized fluid.

10. A method according to claim 1, further comprising applying an axial compressive load to the container during its radial expansion.

11. A method according to claim 10, wherein the radial expansion of the container creates axial tension therein, and wherein the compressive load applied to the container is such that the axial tension created by the radial expansion is substantially canceled.

12. A method according to claim 10, wherein the axial compressive load is applied to the container throughout the entirety of its radial expansion.

13. A method according to claim 10, wherein the container has a compressive strength in the axial direction, and wherein the axial compressive load applied to the container is greater than the axial compressive strength of the container when no pressurized fluid is supplied to the interior cavity of the container.

14. A method according to claim 10, wherein the axial compressive load is applied to the container by applying a pressurized fluid to a piston that transmits force to the container.

15. A method according to claim 14, wherein the pressure of the pressurized fluid supplied to the container interior cavity and the pressure of the pressurized fluid applied to the piston are substantially the same.

16. A method according to claim 14, wherein the pressurized fluid supplied to the container interior cavity is supplied from a source of pressurized fluid, and wherein the pressurized fluid applied to the piston is supplied from the same source of pressurized fluid.

17. A method according to claim 14, wherein the pressure of the pressurized fluid in the container interior cavity rises at a rate, and wherein the pressure of the pressurized fluid applied to the piston rises at a rate, and further comprising the step of controlling the rates of the pressure rises in the container interior cavity and the piston.

18. A method according to claim 14, further comprising the steps of exhausting the pressurized fluid from the container interior cavity and exhausting the pressurized fluid applied to the piston, both of the exhausting steps performed substantially simultaneously.

19. A method according to claim 1, wherein the step of moving the mold parts axially towards each other comprises applying a pressurized fluid to a piston that acts upon one of the mold parts.

20. A method according to claim 19, wherein applying the pressurized fluid to the piston causes the piston to move, and wherein contact of the expanded container with the mold inner surface stops the movement of the piston.

21. An apparatus for reshaping a hollow container having an interior cavity formed therein comprising:

a mold comprising three parts and having an inner surface defining a chamber to accommodate the container, the mold having a longitudinal axis defining an axial direction;

means for supplying a pressurized fluid to the interior cavity of the hollow container to expand the container radially outwards onto the inner surface of the mold; and means for axially moving the mold parts while the container is radially expanding, the axial moving means having means for moving the mold parts towards each other from a first position in which the parts are spaced from each other by gaps which open into the mold chamber to a second position in which the gaps between the mold parts are not closed but are reduced in size whilst still opening into the mold chamber.

22. An apparatus according to claim 21, wherein the mold inner surface forms at least one point at which the container undergoes maximum expansion, and wherein at least one of the gaps in the mold are positioned at the point of maximum expansion.

23. An apparatus according to claim 21, further comprising means for applying a compressive axial load to the container during its radial expansion.

24. An apparatus according to claim 23, in which the means for applying a load comprises a pair of pistons.

25. An apparatus according to claim 24, in which the pistons are actuated by fluid pressure.

26. An apparatus according to claim 25, in which the pressurized fluid is supplied either independently or to any combination of the pistons and the container cavity.

27. An apparatus according to claim 26, in which a single pressurized fluid line supplies one of the pistons and the container cavity and is split adjacent to or within the piston.

28. An apparatus according to claim 5, wherein the means for axially moving the mold parts comprises a piston having a maximum amount of movement, and wherein the means for supplying a pressurized fluid to expand the container radially has means for expanding the container such that contact of the expanded container with the mold inner surface prevents further movement of the piston, whereby the piston will not reach the maximum amount of its movement before the container is fully reshaped.

29. An apparatus according to claim 21, wherein the axial moving means has means for moving the molds parts simultaneously with the radial expansion of the container.

30. A method of reshaping a two piece can into a shape having two or more enlarged regions, the method comprising:

placing a can blank having an interior cavity formed therein into a chamber defined by a mold having an inner surface, the mold comprising three parts spaced from each other by gaps which open into the mold chamber, the mold inner surface defining positions of maximum can expansion corresponding to each of the enlarged regions of the can, and wherein each of the gaps is at, or substantially at, one of the positions of maximum expansion;

supplying a pressurized fluid to the interior cavity of the hollow can blank to expand the can blank radially outwards onto the inner surface of the mold; and moving the mold parts towards each other, but not to an extent that would close gaps that are defined between the mold parts, as the can is being expanded.

31. A method according to claim 30, wherein the movement of the mold parts and the radial expansion of the can blank occurs simultaneously.

32. A method of reshaping a hollow container comprising:

placing a container blank having an interior cavity into a chamber defined by a mold having an inner surface and comprising three parts;

supplying a pressurized fluid to the interior cavity of the hollow container to expand the container radially outwards onto the inner surface of the mold; and moving two of the mold parts towards the third mold part from a first position in which the parts are spaced from each other by gaps which open into the mold chamber to a second position in which the gaps between the mold parts are reduced in size, but not closed, whilst still opening into the mold chamber, the two mold parts being moved toward the third mold part during the radial expansion of the container.

33. A method according to claim 32, wherein the reshaped container has at least two locations defining points at which the container undergoes maximum expansion, and further comprising positioning the gaps at the points of maximum expansion.

34. A method according to claim 32 further comprising applying a load to at least one end of the container during its radial expansion.

35. A method according to claim 34, comprising balancing the force exerted by the pressurized fluid on the interior of the container and the load applied to the end or the ends of the container.

36. A method according to claim 32, wherein the movement of the mold parts and the radial expansion of the container occurs simultaneously.

37. An apparatus for reshaping a hollow container having an interior cavity formed therein comprising:

a mold having an inner surface and comprising three parts defining a chamber to accommodate the container, the mold having a longitudinal axis defining an axial direction;

means for supplying a pressurized fluid to the interior cavity of the hollow container to expand the container radially outwards onto the inner surface of the mold; and means for axially moving two of the mold parts towards the third mold part while the container radially expands, the axial moving means having means for moving the two mold parts from a first position in which the parts are spaced from each other by gaps which open into the mold chamber to a second position in which the gaps between the mold parts are reduced in size, but not closed, whilst still opening into the mold chamber.

38. An apparatus according to claim 37, wherein the mold inner surface forms at least one point at which the container undergoes maximum radial expansion, and wherein at least one of the gaps in the mold are positioned at the point of maximum expansion.

39. An apparatus according to claim 37 further comprising means for applying an axial load to the container during its radial expansion.

40. An apparatus according to claim 39, in which the means for applying a load comprises at least one piston.

41. An apparatus according to claim 40, in which the pistons are actuated by fluid pressure.

42. An apparatus according to claim 41, in which the pressurized fluid is supplied either independently or to any combination of the piston or pistons and container cavity.

43. An apparatus according to claim 42, in which a single pressurized fluid line supplies the piston or one of the pistons and the container cavity and is split adjacent to or within the piston.

44. An apparatus according to claim 42, wherein the means for moving the mold parts comprises a piston having a maximum amount of movement, and wherein the means for supplying a pressurized fluid to radially expand the container has means for expanding the container such that contact of the expanded container with the mold inner surface prevents further movement of the piston whereby the piston will not reach the maximum amount of its movement before the container is fully reshaped.

45. An apparatus according to claim 37, wherein the axial moving means has means for moving the two molds parts toward the third part simultaneously with the radial expansion of the container.

46. A method of reshaping a two piece can into a shape having two or more enlarged regions, the method comprising:

placing a hollow can blank having an interior cavity formed therein into a chamber defined by a mold having an inner surface, the mold comprising three parts spaced from each other by gaps which open into the mold chamber, the mold chamber defining a position of maximum expansion corresponding to each of the enlarged regions of the can shape, and wherein each of the zaps is at, or substantially at, one of the positions of maximum expansion;

supplying a pressurized fluid to the interior cavity of the hollow can blank to expand the can blank radially outwards onto the inner surface of the mold; and moving two of the mold parts towards the third mold part, but not completely closing the gaps between the mold parts, as the can is being expanded.

47. A method according to claim 46, wherein the movement of the two mold parts toward the third part and the radial expansion of the can blank occur simultaneously.

* * * * *

UNITED STATES PATENT AND TRADEMARK OFFICE

CERTIFICATE OF CORRECTION

PATENT NO. : 5,829,290

DATED : November 3, 1998

INVENTOR(S) : Harvey

It is certified that error appears in the above-indentified patent and that said Letters Patent is hereby corrected as shown below:

Title Page, Column 1, beneath "Foreign Application Priority Data" delete "9603110" and insert --9603110.9-- therefor.
Title Page, Column 1, beneath "Foreign Application Priority Data" delete "9604784" and insert --9604784.0-- therefor.
Page 2, Column 2, beneath "Foreign Patent Documents" delete "0 543 695 A1 11/1992 France" and insert - -0 543 695 A1 5/1993 EPO- - therefor.
Page 2, Column 2, line 9, delete "2 003 416" and insert --2 003 416A-- therefor.
Page 2, Column 2, line 10, delete "2 123 329" and insert --2 123 329A-- therefor.
Page 2, Column 2, line 11, delete "2120148" and insert --2120148B-- therefor.
Page 2, Column 2, line 12, delete "2 224 965" and insert --2 224 965A-- therefor.
Page 2, Column 2, line 14, delete "2 266 290" and insert --2 266 290A-- therefor.
Column 1, Line 11, delete "mould" and insert --mold-- therefor.
Column 1, Line 14, delete "mould" and insert --mold-- therefor.
Column 1, Line 44, delete "mould" and insert --mold-- therefor.
Column 1, Line 49, delete "mould." and insert --mold.-- therefor.
Column 1, Line 50, delete "steep, the press" and insert -- step, the press-- therefor.
Column 1, Line 50, delete "mould" and insert --mold-- therefor.
Column 1, Line 53, delete "mould." and insert --mold.-- therefor.
Column 2, Line 8, delete "mould" and insert --mold-- therefor.
Column 2, Line 11, delete "mould;" and insert --mold;-- therefor.

UNITED STATES PATENT AND TRADEMARK OFFICE

CERTIFICATE OF CORRECTION

PATENT NO. : 5,829,290

DATED : November 3, 1998

INVENTOR(S) : Harvey

It is certified that error appears in the above-indentified patent and that said Letters Patent is hereby corrected as shown below:

Column 2, Line 12, delete "mould" and insert --mold-- therefor.
Column 2, Line 14, delete "into the could chamber," and insert -- into the mold chamber,-- therefor. "
Column 2, Line 15, delete "mould" and insert --mold-- therefor.
Column 2, Line 16, delete "mould" and insert --mold-- therefor.
Column 2, Line 18, delete "mould" and insert --mold-- therefor.
Column 2, Line 22, delete "mould" and insert --mold-- therefor.
Column 2, Line 25, delete "mould" and insert --mold-- therefor.
Column 2, Line 29, delete "mould" and insert --mold-- therefor.
Column 2, Line 32, delete "mould" and insert --mold-- therefor.
Column 2, Line 35, delete "mould." and insert --mold.-- therefor.
Column 2, Line 37, delete "mould" and insert --mold-- therefor.
Column 2, Line 40, delete "mould." and insert --mold.-- therefor.
Column 2, Line 42, delete "mould," and insert --mold,-- therefor.
Column 2, Line 43, delete "mould," and insert --mold,-- therefor.
Column 2, Line 49, delete "mould" and insert --mold-- therefor.
Column 2, Line 60, delete "mould" and insert --mold-- therefor.
Column 3, Line 17, delete "mould" and insert --mold-- therefor.
Column 3, Line 31, delete "mould" and insert --mold-- therefor.
Column 3, Line 32, delete "mould" and insert --mold-- therefor.
Column 3, Line 37, delete "mould, and moving the mould" and insert --mold, and moving the mold- therefor.
Column 3, Line 41, delete "mould" and insert --mold-- therefor.
Column 3, Line 45, delete "mould;" and insert --mold;-- therefor.
Column 3, Line 46, delete "mould" and insert --mold-- therefor.
Column 3, Line 48, delete "mould" and insert --mold-- therefor.
Column 3, Line 49, delete "mould" and insert --mold-- therefor.
Column 3, Line 50, delete "mould" and insert --mold-- therefor.
Column 3, Line 60, delete "mould" and insert --mold-- therefor.
Column 3, Line 64, delete "mould" and insert --mold-- therefor.

UNITED STATES PATENT AND TRADEMARK OFFICE

CERTIFICATE OF CORRECTION

PATENT NO. : 5,829,290

DATED : November 3, 1998

INVENTOR(S) : Harvey

It is certified that error appears in the above-indentified patent and that said Letters Patent is hereby corrected as shown below:

Column 4, Line 14, delete "mould" and insert --mold-- therefor.
Column 4, Line 35, delete "mould" and insert --mold-- therefor.
Column 4, Line 38, delete "mould" and insert --mold-- therefor.
Column 5, Line 1, delete "mould" and insert --mold-- therefor.
Column 5, Line 5, delete "mould" and insert --mold-- therefor.
Claim 28, Column 7, Line 47, delete "according to claim 5," and insert --according to claim 21,-- therefor.
Claim 44, Column 9, Line 15, delete "according to claim 42, "and insert -- according to claim 37,-- therefor.
Claim 46, Column 10, Line 13, delete "of the zaps" and insert --of the gaps-- therefor.

Signed and Sealed this

Eleventh Day of January, 2000

*Attest:*

*Attesting Officer*

Q. TODD DICKINSON

*Acting Commissioner of Patents and Trademarks*